US008869988B2

(12) United States Patent
Stachura et al.

(10) Patent No.: US 8,869,988 B2
(45) Date of Patent: Oct. 28, 2014

(54) COOLING AND CLASSIFYING APPARATUS FOR PELLETIZED PRODUCT PROCESSING

(75) Inventors: Henry P. Stachura, Burlington, KY (US); Donald J. Canavan, Florence, KY (US); Joachim M. Zaun, Fort Thomas, KY (US)

(73) Assignee: M-I L.L.C., Houston, TX (US)

( * ) Notice: Subject to any disclaimer, the term of this patent is extended or adjusted under 35 U.S.C. 154(b) by 716 days.

(21) Appl. No.: 12/117,407

(22) Filed: May 8, 2008

(65) Prior Publication Data

US 2009/0277818 A1 Nov. 12, 2009

(51) Int. Cl.
*B07B 1/46* (2006.01)
*F26B 17/00* (2006.01)

(52) U.S. Cl.
CPC ..... *B07B 1/469* (2013.01); *F26B 17/006* (2013.01); *B07B 2201/04* (2013.01)
USPC ..... 209/238; 209/240; 209/241; 209/247; 209/251; 209/315

(58) Field of Classification Search
USPC ..... 209/238, 240, 241, 247, 257, 315, 316, 209/317, 318
IPC ..... B07B 1/469,1101/04; F26B 17/006
See application file for complete search history.

(56) References Cited

U.S. PATENT DOCUMENTS 2,416,499 A * 2/1947 Saxe ..... 209/287
2,452,362 A * 10/1948 Erisman ..... 209/28
2,698,086 A * 12/1954 Vogel ..... 209/11
3,061,095 A * 10/1962 O'Malley ..... 209/17
3,416,660 A * 12/1968 Larsson ..... 209/254
3,452,868 A * 7/1969 Miller ..... 209/254
3,485,363 A * 12/1969 Talley, Jr ..... 209/240
3,819,050 A * 6/1974 Lower ..... 209/254
3,928,188 A * 12/1975 Link et al. ..... 209/250
3,963,608 A * 6/1976 Zimmermann et al. ..... 209/300
4,125,945 A * 11/1978 Westelaken ..... 34/65
4,293,407 A * 10/1981 Locker ..... 209/253
4,394,394 A * 7/1983 Nava et al. ..... 426/285
4,415,444 A * 11/1983 Guptail ..... 209/3
4,686,779 A * 8/1987 Wyatt et al. ..... 34/168
4,785,554 A * 11/1988 Hederer et al. ..... 34/164
4,968,366 A * 11/1990 Hukki et al. ..... 156/153
6,230,421 B1 * 5/2001 Reed et al. ..... 34/401
6,613,191 B2 * 9/2003 Rienecker et al. ..... 162/55
6,702,120 B1 * 3/2004 Forslund et al. ..... 209/270
7,373,996 B1 * 5/2008 Martin et al. ..... 175/206
7,445,170 B2 * 11/2008 Cialone et al. ..... 241/24.17

(Continued)

*Primary Examiner* — Stefanos Karmis
*Assistant Examiner* — Michael E Butler
(74) *Attorney, Agent, or Firm* — Patents + TMS, P.C.

(57) ABSTRACT

A cooler for particulate product includes a substantially enclosed housing. A first cooling screen is disposed in the housing and is configured to receive the product. The first cooling screen is configured to move the product along a surface by gravity when the first cooling screen vibrated. A duct is coupled to the first cooling screen to move cooling fluid through the first cooling screen. A second cooling screen is disposed in the housing below the first screen and is configured to receive the product after discharge from the first screen. The second screen is configured to move the particulate product along a surface when vibrated. A second duct is coupled to the second screen to move cooling fluid through the screen. A collector receives the particulate product after moving along a surface of the second screen. A vibrator is coupled to the housing and vibrates the housing.

17 Claims, 3 Drawing Sheets

(56) References Cited

U.S. PATENT DOCUMENTS

| | | | | |
|---|---|---|---|---|
| 8,113,356 | B2 * | 2/2012 | Burnett | 209/315 |
| 2002/0153287 | A1 * | 10/2002 | Fallon | 209/311 |
| 2004/0094641 | A1 * | 5/2004 | Chen | 241/19 |
| 2005/0072717 | A1 * | 4/2005 | Purohit et al. | 209/309 |
| 2005/0209354 | A1 * | 9/2005 | Martel et al. | 521/184 |
| 2007/0045158 | A1 * | 3/2007 | Johnson | 209/11 |
| 2010/0062529 | A1 * | 3/2010 | Zimmermann et al. | 435/379 |

* cited by examiner

COOLING AND CLASSIFYING APPARATUS FOR PELLETIZED PRODUCT PROCESSING

BACKGROUND OF THE INVENTION

1. Field of the Invention

The invention relates generally to the field of manufacturing and processing of product in particle form, such as pellets. More specifically, the invention relates to apparatus for cooling, removal of fines and dust, and classification of pelletized product after forming the product.

2. Background Art

Products in the form of particles or pellets may be made, for example, by extrusion of material heated near above its fusion temperature among other processes. Examples of such materials include thermoplastic. After extrusion and cutting to selected lengths, the product pellets may be subjected to processes such as removal of small size material particles, referred to as "streamers", "ribbons" and "angel hairs." The product pellets may also be cooled, have dust removed from the exterior surface of the pellets, and then be classified, e.g., by size, so that oversize pellets may be removed from the product.

An example of a device that may perform a combination of the foregoing functions is sold by The Witte Company, 507 Route 31 South. Washington, N.J. 07882-0047 under its model designation "400 Dryer/Cooler/Classifier." A side view of such example device is shown in FIG. 1, wherein pelletized product, which may be in slurry form in water may be introduced into the device where shown. Water may be removed in a "dewaterer". The pellets may be dried using forced air in a dryer. Subsequent to drying, the pellets may be cooled by application of forced air. The pellets may then be classified to remove oversized pellets, called "overs." The pellets are transported through each of the foregoing parts of the device by a conveyor screen. The conveyor screen is configured to move in one direction to transport the pellets, and may be agitated in a direction transverse to the direction of motion of the conveyor screen to reduce piling of the pellets on each other on the screen. Fines may be extracted by suitable air flow through an air discharge outlet located above the dryer/cooler portion of the device.

The device shown in FIG. 1 has proven effective, however there is still a need for improved drying and classifying devices for pellet product manufacturing.

SUMMARY OF THE INVENTION

A cooling apparatus for selected size particulate product according to one aspect of the invention includes a substantially enclosed housing. A first cooling screen is disposed in the housing and is configured to receive the particulate product. The first cooling screen is configured to move the particulate product along a surface by gravity when the first cooling screen is subjected to vibration. A first duct is coupled to the first cooling screen and is configured to move cooling fluid through the first cooling screen through a wall of the housing. A second cooling screen is disposed in the housing below the first cooling screen and is configured to receive the particulate product after discharge from the first cooling screen. The second cooling screen is configured to move the particulate product along a surface by gravity when the second cooling screen is subjected to vibration. A second duct is coupled to the second cooling screen and configured to move cooling fluid through the second cooling screen through a wall of the housing. A product collector is configured to receive particulate product after moving along a surface of the second cooling screen. A vibrator coupled to the housing and configured to impart selected vibratory motion to the housing.

Other aspects and advantages of the invention will be apparent from the following description and the appended claims.

DETAILED DESCRIPTION

Figure 1:
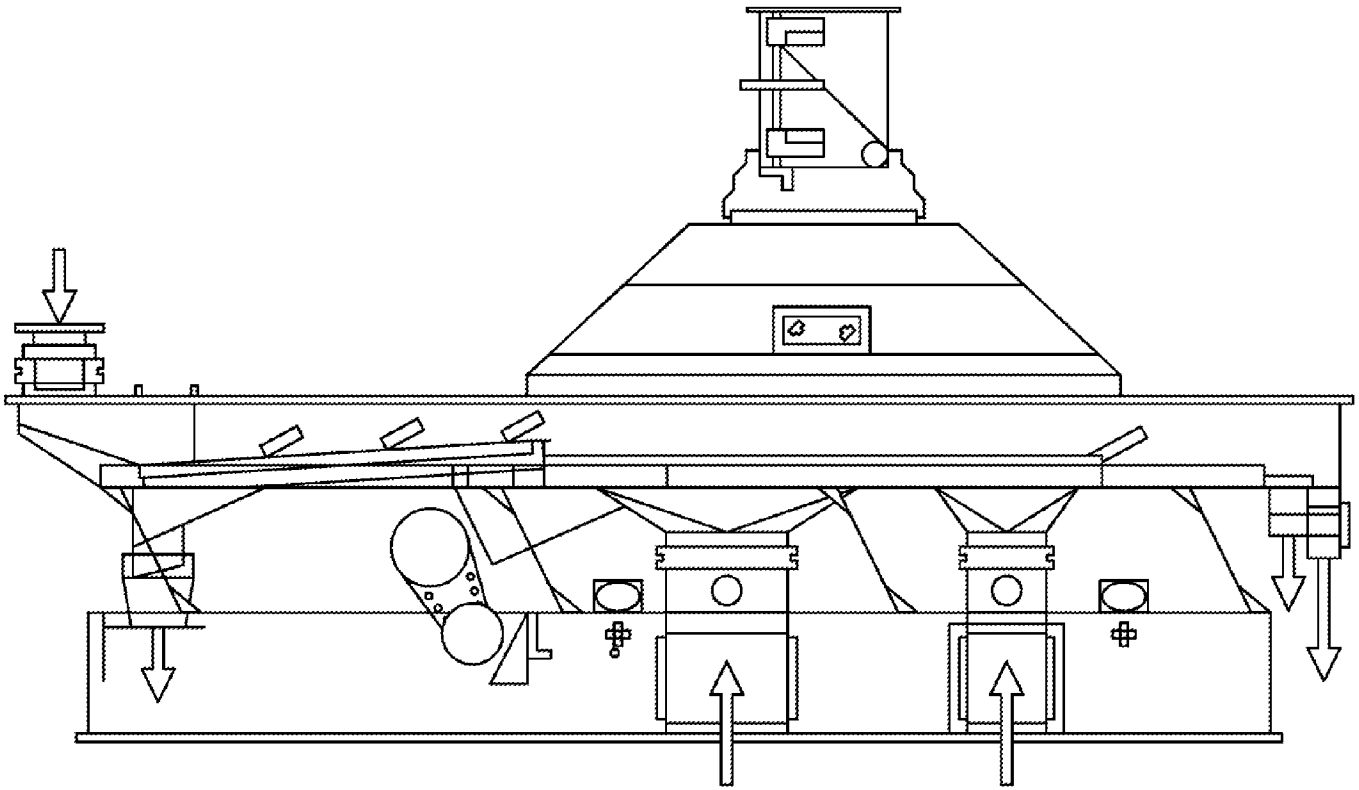
FIG. 1 (Prior Art)
FIG. 1 shows an example of a prior art dryer/cooler/classifier.
Figure 2:
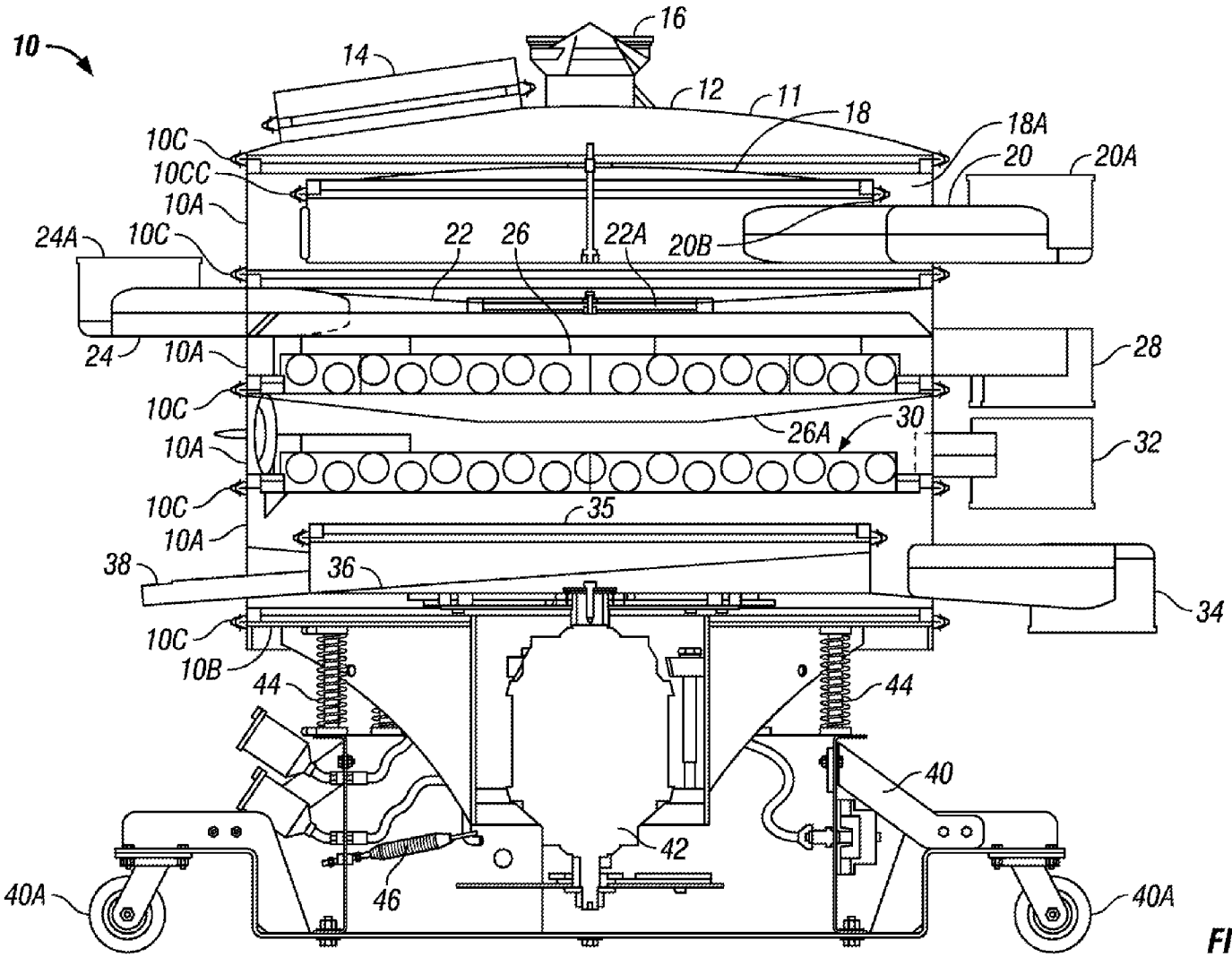
FIG. 2 shows a cross section view of one example of a cooler/classifier according to the invention.

An example pelletized product cooler/classifier device is shown in cross-sectional view in FIG. 2. Functional components of the device 10 can be disposed inside a generally cylindrically shaped housing 11. The housing 11 can be assembled from a plurality of substantially cylindrically shaped housing segments 10A. The housing segments 10A may be shaped essentially as short length, relatively large diameter cylinders each having flanges formed or affixed at the longitudinal ends thereof for coupling to a corresponding flange on an adjacent one of the housing segments 10A or to other devices as will be explained below. On the bottom end of the assembled housing segments 10A the lowermost housing segment 10A may be coupled such as by a flange to a base plate 10B (to be explained further below). The upper end of the assembled housing segments 10A may be coupled, such as to a corresponding flange surface, to a housing cover 12. Coupling of the various segments 10A to each other, to the base plate 10B and to the cover 12 may be performed using band clamps 10C affixed to the exterior of the flanges (not shown). Depending on the particular application, the flange surfaces may include a seal or gasket (not shown) therebetween, however the use of such gasket or seal is not a limit on the scope of the present invention. Generally, the housing 11 when assembled encloses all the functional components of the device 10 so that they are not exposed to the ambient environment.

The cover 12 may be generally dome shaped as shown in FIG. 2, although the exact shape is not a limit on the scope of the invention. The cover 12 may include a generally centrally located product inlet 16, through which product in the form of particles or pellets may pass from their point of fabrication. The exact position of the product inlet 16 may be somewhat different in different implementations than as shown in FIG. 2, but in principle the product inlet 16 should enable flow of the pellets (not shown in the figures) approximately into the center of an upper cooling screen 18 (explained further below). The cover 12 may include, closer to the lateral edge of the cover 12 a cooling fluid duct 14. As used herein, the term "cooling fluid" may include any fluid intended to remove heat from the pellets by flow of the cooling fluid over the pellets in interior of the device 10. Typically, the cooling fluid will be in the gas phase, and more typically will be air. However, as will be explained below in more detail, the structure of the device 10 may enable the use, in particular, of other gases for the cooling fluid in circumstances where the use of such gases may be advantageous. Therefore, any reference to "cooling fluid" herein is intended to explain the principle of operation of the device 10 and is not intended to limit the type of cooling fluid that may be used in any particular example. Advantageously, in some examples, the cooling fluid may be introduced into the housing 11 through the duct 14, and in other examples, the cooling fluid may be discharged from the housing 11 through the duct 14. Such introduction and discharge of cooling fluid will be further explained below.

The housing segments 10A and the cover 12 may be made from any suitable material for an enclosure, such as steel, stainless steel, woven mesh reinforced plastic, or fiber reinforced plastic, for example. The thickness and strength of the material used to make the housing segments 10A and the cover 12 may be selected to provide sufficient structural support for the functional components (explained below) disposed inside the housing 11 under vibration imparted to the housing 11 during operation of the device 10. The vibration will be explained further below.

The upper cooling screen 18 referred to above is preferably generally conically shaped, may have a circular outer lateral edge, and is preferably configured such that the slope of the upper surface thereof is directed downwardly from the center to the outer lateral edge of the upper cooling screen 18. The upper cooling screen may have a mesh size selected to enable product pellets (not shown) to move along the upper surface of the screen 18 without passing therethrough, while enabling movement through the upper cooling screen 18 of the cooling fluid (typically air) and "fines" (e.g., ribbons, angel hairs and streamers). The external diameter of the upper cooling screen 18 is preferably selected to create an annular space 18A between the outer edge of the upper cooling screen 18 and the interior wall of the associated-housing segment 10A.

The upper cooling screen 18 may be mounted to the top of an upper cooling screen duct 20. The upper cooling screen duct 20 may have a screen opening 20B sized and shaped to substantially match the exterior lateral edge of the upper cooling screen 18. The upper cooling screen 18 may be affixed to the screen opening 20B using, for example, a band clamp 10CC or similar device, although the exact type of device used to affix the screen 18 to the opening 20B is not intended to limit the scope of the present invention. In order to obtain certain possible benefits of the device of the present invention, it is contemplated that any device used to affix the screen 18 to the opening 20B is operated to enable relatively easy removal and replacement of the screen 18 on the upper cooling screen air duct 20. The upper cooling screen duct 20 may be formed to provide an enclosed cooling fluid (e.g., air) passage from the screen opening 20B to an external duct opening 20A disposed outside the associated housing segment 10A. In one example, the upper cooling screen duct 20 may include a substantially cylindrical or rectangular conduit that passes through a similarly shaped opening in the wall of the housing segment 10A. In some examples, the combination of the upper cooling screen 18, the upper cooling screen duct 20 and the associated housing segment 10A may be assembled as a unit prior to assembly of the entire device.

A lower cooling screen 22 may be disposed in a housing segment 10A disposed adjacent to and below the upper cooling screen 18. The lower cooling screen 22 may have similar or different mesh size than the upper cooling screen 18, and such size is intended to enable the product pellets (not shown) to move along the upper surface of the lower cooling screen 22 without passing therethrough, just as is the case with the upper cooling screen 18. The lower cooling screen 22 may have an external diameter substantially the same as the internal diameter of the housing segment 10A, although for purposes of function, it is only necessary for the lower cooling screen 22 to be able to efficiently receive product pellets that fall from the outer lateral edge of the upper cooling screen 18. A lower cooling screen duct 24 may be formed with respect to the lower cooling screen 22 in a manner corresponding to the form of the upper cooling screen duct 20 with respect to the upper cooling screen 18, and the lower cooling duct 24 may include a corresponding external duct opening 24A for introduction or extraction of cooling fluid, as will be further explained below. The lower cooling screen 22 can also be generally conically shaped, and may include a slope that extends downwardly from the exterior lateral edge to the center, that is, in a direction opposed to that of the slope of the upper cooling screen 18. The lower cooling screen 22 may include an opening 22A in the center to enable passage therethrough of pellets after cooling has taken place on the lower cooling screen 22. The lower cooling screen 22, lower cooling screen duct 24 and associated housing segment 10A may be preassembled in some examples, just as the combination including the upper cooling screen 18.

Both die upper cooling screen 18 and the lower cooling screen 22, if made as explained above, would be coupled to the respective screen ducts 20, 24 so that substantially all the cooling fluid moved through the ducts 20, 24 must pass through the respective cooling screen 18, 22. Such configuration may improve cooling efficiency by causing substantially all the cooling fluid to be directed through the cooling screens.

In some examples, the device 10 may include more than one each of upper cooling screen and lower cooling screen. Advantageously, other examples of a device including cooling screens as explained above, being modular in structure, may include several upper and lower cooling screens successively coupled on top of each other in the same manner as the upper and lower cooling screens shown in FIG. 2.

After the cooled pellets move through the center opening 22A in the lower cooling screen 22, they may be discharged onto a first classification plate 26. The first classification plate 26 may be disposed in an associated housing segment 10A and may include a perforated plate that includes opening (not shown in FIG. 2) of a size selected to enable passage therethrough of correctly sized pellets, and deflection to the lateral edges of the first classification plate 26 of oversized pellets. Pellets moved to the lateral edge of the first classification plate 26 may exit the device 10 through a suitable "overs" discharge duct or outlet 28 coupled through the wall of the housing segment 10A. The combination of classification plate 26 and overs outlet 28 may be preassembled to the associated housing segment 10A as is the case with the upper and lower cooling screens explained above.

The example shown in FIG. 2 may include a second classification plate 30 in an associated housing segment 10A just below the first classification plate 26. As shown in FIG. 2, the first classification plate 26 may include a conically shaped product catcher 26A to direct the pellets moving through the first classification plate 26 approximately to the center of the second classification plate 30. The second classification plate 30 may include a discharge duct or outlet 32 associated therewith. The operation of the second classification plate 30 may be substantially the same as that described above with reference to the first classification plate 26.

Pellets that pass through the second classification plate 30, and are thus deemed to be correct size for the particular pelletized product, may pass to a dedusting plate or screen 35 in a housing segment 10A disposed below the second classification plate 30. The dedusting plate 35 may be affixed to the top of a suitably shaped duct 36 having an external discharge opening 38 through the wall of the housing segment 10A to enable extraction of dust that passes through the dedusting plate 35.

Pelletized product can be extracted from the interior of the housing 11 through a product discharge outlet 34 coupled through a wall of the associated housing segment 10A.

The base plate 10B may form part of a device support frame that is movably affixed to a base frame 40. Movable affixing of the base plate 10B to the base frame 40 may include suspension by devices such as springs 44, 46 that enable the base plate 10B to move with respect to the base frame 40 in any selected direction. The base frame 40 may be made more easily transportable by including casters 40A at selected positions thereon to make contact between the frame 40 and the ground or floor surface. A vibrator 42 may be coupled between the base frame 40 and the base plate 10B to provide vibratory motion to the housing in selected directions and with certain selected types of motion. The vibrator 42 may, but need not necessarily provide motion along all three mutually orthogonal directions, such as in a three dimensional oscillatory pattern. The type of vibratory motion may be optimized to provide particular results along the upper surfaces of the cooling screens 18, 22, such as reducing the amount of piling of pellets on top of each other (i.e., increasing the number of pellets confined to a single layer) and reducing any backup of pellets along any screen, plate or duct. The vibratory motion also may be selected to increase the removal of fines and dust from the pellets. The use of such a vibrator may provide advantages in efficiency of operation of the device 10 as contrasted with prior art cooler/classifiers, which provide vibratory motion of the screens along essentially only one direction transverse to the direction of transport of the pellets.

Figure 3:
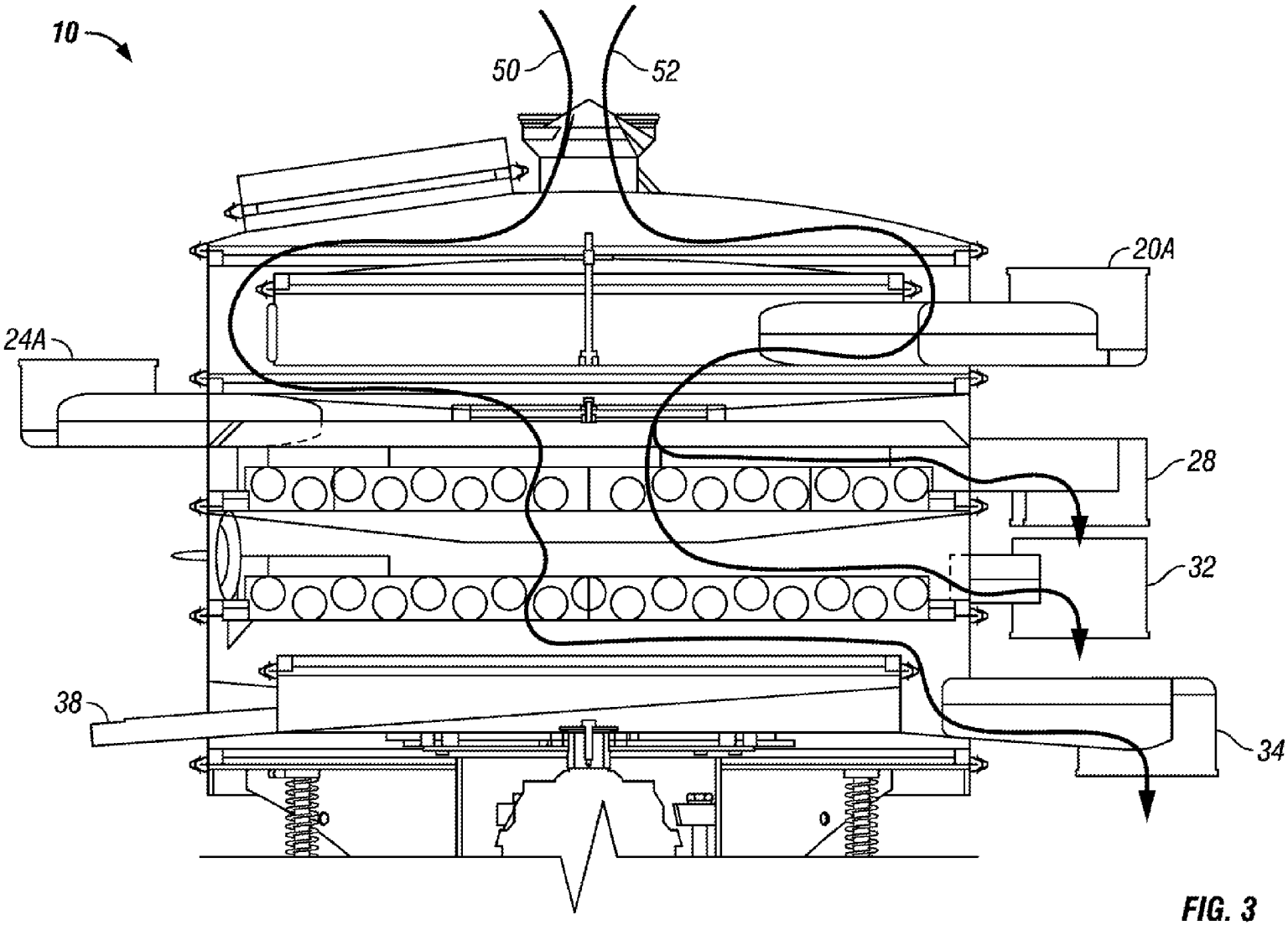
FIG. 3 shows a cut away view of the example cooler/classifier of FIG. 2 in which flow of correctly sized pellets and oversize pellets through the classifier portion is illustrated.

Referring to FIG. 3, flow of the pellets through the device 10 is shown in partial cross section along a first path, shown by arrow 50 for product of the correct size to pass through both the first and second classification plates, and along a second path 52 for product that is too large to pass through the first 26 and second 30 classification plates.

A device made as explained above according to various aspects of the invention, and once again referring to FIG. 2, may have one or more advantages over cooling and classification devices known in the art prior to the present invention. First, the use of conically shaped cooling screens 18, 22 may reduce the amount of piling of pellets on top of each other, so as to increase effective cooling surface area, thus increasing cooling efficiency. The arrangement of cooling fluid ducts 20, 24 with respect to the cooling screens 18, 22 may enable flow of the cooling fluid in either direction with respect to the duct openings 20A, 24A and the duct 14 in the cover 12. It has been determined that for certain size pellets and for certain pellet materials, cooling efficiency may be improved by introducing air through the cover duct 14 and discharging air through the duct openings 20A, 24A. Other size pellets and/or materials may benefit by having the cooling fluid move in the opposite direction.

The structure of the housing 11 makes it possible to perform cooling, classification, dedusting and fines removal inside a substantially sealed enclosure. Such enclosure may make it possible to reduce contamination of the pellets during processing, or may make it possible to process pellets that may be reactive with certain cooling fluids, including air. It is within the scope of the present invention to use non-reactive cooling fluids, such as nitrogen or noble gases for the cooling fluid in the event reactive pellets are processed. Another possible advantage is that the efficiency with which the cooling fluid moves over the pellets on the cooling screens (18, 22 in FIG. 2) may enable deletion of the dedusting screen (35 in FIG. 2) and associated components in some cases. Other possible advantages of a device according to the invention include relatively easy disassembly for cleaning and replacement of the screens and other internal components. The structure of the device as shown and as explained above may facilitate movement of the device, and may provide the device with substantially reduced "footprint" as contrasted with devices known in the art prior to the present invention. The structure of the device is modular, and so additional cooling screens may be used in some examples to provide more cooling if such is required without increasing the floor space ("footprint") occupied by the device. The modular assembly and the manner of affixing the cooling screens and classification plates to the respective ducting may facilitate disassembly for cleaning and maintenance.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus comprising:

a substantially enclosed housing;

a first cooling screen disposed in the housing configured to receive the particulate product, the first cooling screen configured to move the particulate product along a surface by gravity when the first cooling screen is subjected to vibration wherein the first cooling screen has an exterior lateral edge;

a first duct directly coupled to the first cooling screen extending to a first external duct opening such that a cooling fluid moves through the first duct and a majority of the cooling fluid passes through the first cooling screen wherein the first duct has a screen opening having a size and shape that substantially matches the exterior lateral edge of the first cooling screen;

a second cooling screen disposed in the housing below the first cooling screen and configured to receive the particulate product after discharge from the first cooling screen, the second cooling screen configured to move the particulate product along a surface by gravity when the second cooling screen is subjected to vibration wherein the second cooling screen has a conical shape such that a slope extends downwardly from an exterior lateral edge of the second cooling screen to the center of the second cooling screen;

a second duct directly coupled to the second cooling screen extending to a second external duct opening such that the cooling fluid moves through the second duct and a majority of the cooling fluid passes through the second cooling screen;

a product collector configured to receive particulate product after moving along a surface of the second cooling screen; and a vibrator coupled to the housing and configured to impart selected vibratory motion to the housing.

2. The apparatus of claim 1 wherein the product collector comprises a first classification plate disposed in the housing proximate the second cooling screen, the first classification plate including openings enabling passage therethrough of particles having at most a selected size.

3. The apparatus of claim 2 further comprising a second classification plate disposed in the housing and configured to receive particles passing through the openings in the first classification plate, the second classification plate including openings enabling passage therethough of particles having at most a selected size.

4. The apparatus of claim 3 further comprising a product outlet passing through a wall of the housing and configured to receive particles passing through the openings in the first classification plate and the second classification plate.

5. The apparatus of claim 1 further comprising a cover disposed on an upper end of the housing, the cover including an opening for receiving particles therethrough, the opening arranged to deposit the particles on the surface of the first cooling screen.

6. The apparatus of claim 5 wherein the cover includes a duct for passage therethrough of the cooling fluid.

7. The apparatus of claim 1 wherein the first cooling screen and the first duct are disposed in a housing segment, the housing segment including a coupling at its longitudinal end for coupling to at least one of an adjacent housing segment, a housing cover and a housing baseplate.

8. The apparatus of claim 7 wherein the coupling comprises a flange and a band clamp.

9. The apparatus of claim 1 wherein the second cooling screen and the second duct are disposed in a housing segment, the housing segment including a coupling at its longitudinal ends for coupling to at least one of an adjacent housing segment, a housing cover and a housing baseplate.

10. The apparatus of claim 9 wherein the coupling comprises a flange and a band clamp.

11. The apparatus of claim 1 further comprising a dedusting screen disposed in the housing below the second cooling screen.

12. The apparatus of claim 1 wherein the first duct and second duct are configured to enable movement of the cooling fluid in either direction therethrough.

13. The apparatus of claim 1 wherein the first cooling screen has a conical shape such that a slope of the surface is directed downwardly from the center to an outer lateral edge.

14. The apparatus of claim 1 wherein the cooling fluid is air.

15. The apparatus of claim 1 wherein the cooling fluid is selected from a group consisting of nitrogen and noble gas.

16. The apparatus of claim 1 wherein the first external duct opening of the first duct is disposed outside the housing for introduction or extraction of the cooling fluid that moves through the first duct.

17. The apparatus of claim 1 wherein the second external duct opening of the second duct is disposed outside the housing for introduction or extraction of the cooling fluid that moves through the second duct.

* * * * *